US011117780B1

(12) United States Patent
Rhoads et al.

(10) Patent No.: US 11,117,780 B1
(45) Date of Patent: Sep. 14, 2021

(54) APPARATUS AND METHOD FOR SPOOLING WIRE

(71) Applicant: Encore Wire Corporation, McKinney, TX (US)

(72) Inventors: John L. Rhoads, The Colony, TX (US); Kevin D. Rodgers, Frisco, TX (US)

(73) Assignee: Encore Wire Corporation, McKinney, TX (US)

( * ) Notice: Subject to any disclaimer, the term of this patent is extended or adjusted under 35 U.S.C. 154(b) by 97 days.

(21) Appl. No.: 16/422,614

(22) Filed: May 24, 2019

Related U.S. Application Data

(60) Provisional application No. 62/677,061, filed on May 27, 2018.

(51) Int. Cl.
*B65H 75/44* (2006.01)
*B65H 75/14* (2006.01)

(52) U.S. Cl.
CPC ..... *B65H 75/4486* (2013.01); *B65H 75/146* (2013.01); *B65H 2701/34* (2013.01)

(58) Field of Classification Search
CPC ..... B65H 75/146; B65H 75/4486; B65H 2701/34; B65H 49/32
See application file for complete search history.

(56) References Cited

U.S. PATENT DOCUMENTS 709,932 A * 9/1902 Schooley ..... B65H 49/32 242/557
970,884 A 9/1910 Carter
3,152,772 A * 10/1964 Schjerven ..... B65H 49/38 242/557
3,652,026 A * 3/1972 Awebro ..... B65H 75/145 242/557
3,976,260 A * 8/1976 Irik ..... B65H 49/38 242/403
4,784,221 A * 11/1988 Share ..... B65H 54/74 166/52
6,361,021 B1 * 3/2002 Brennan ..... B65H 75/305 254/134.3 FT (Continued)

FOREIGN PATENT DOCUMENTS

GB 353684 A 7/1931

OTHER PUBLICATIONS

Carrisreels, "10-inch Caddies for in-the-box packaging reels from Canis Reels", Carris Reels, Inc. 2008, http://carris.com/products/caddy10.html (Printed from website Oct. 11, 2012).

*Primary Examiner* — Michael E Gallion
(74) *Attorney, Agent, or Firm* — Warren Rhoades LLP

(57) ABSTRACT

A reel apparatus comprising a pipe; an outer flange assembly comprising two outer support walls connected to the pipe and wherein each outer support wall comprises an inner wall and an outer wall; an inner flange assembly comprising two inner support walls, wherein the inner flange assembly is rotated relative to the outer flange assembly and the pipe and wherein each inner support wall comprises an inner wall and an outer wall; and a motor assembly connected to the inner flange assembly and outer flange assembly, wherein the motor assembly is physically connect to the outer flange assembly and wherein the motor assembly is rotationally connected to the inner flange assembly.

20 Claims, 7 Drawing Sheets

(56) References Cited

U.S. PATENT DOCUMENTS

| | | | | |
|---|---|---|---|---|
| 8,025,261 | B2 | 9/2011 | Jordan et al. | |
| 8,245,965 | B2 | 8/2012 | Andrea et al. | |
| 8,444,078 | B1 | 5/2013 | Brown et al. | |
| 9,452,908 | B1 * | 9/2016 | Bigbee, Jr. | B65H 49/324 |
| 10,000,356 | B1 * | 6/2018 | Bigbee, Jr. | B65H 75/146 |
| 10,207,891 | B1 * | 2/2019 | Bigbee, Jr. | B65H 49/32 |
| 10,421,636 | B1 * | 9/2019 | Bigbee, Jr. | B65H 75/40 |
| 2002/0005451 | A1 * | 1/2002 | Valverde | B66C 13/44 242/390.2 |
| 2008/0023579 | A1 * | 1/2008 | Leonard | B65H 75/22 242/390.8 |
| 2010/0084500 | A1 * | 4/2010 | Inman | B65H 75/4471 242/390.8 |
| 2010/0230528 | A1 | 9/2010 | Singleton | |
| 2011/0095124 | A1 * | 4/2011 | Andrea | B65H 49/32 242/474.8 |
| 2015/0129703 | A1 * | 5/2015 | Kucera | B65H 75/4486 242/390.8 |
| 2015/0321876 | A1 * | 11/2015 | Galindo Gonzalez | B65H 75/40 242/611 |
| 2017/0008718 | A1 * | 1/2017 | Evans | B60P 7/0846 |

* cited by examiner

APPARATUS AND METHOD FOR SPOOLING WIRE

CROSS-REFERENCE TO RELATED APPLICATIONS

This application claims priority benefit to U.S. Provisional Application No. 62/677,061, filed May 27, 2018 and is incorporated in its entirety by reference herein.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The present disclosure generally relates to apparatuses and methods for spooling wire, and more particularly, to a compact reel assembly capable of spooling wire independent of a jack stand or other reel support or spooling device.

2. Description of Related Art

To distribute electricity throughout a building, insulated electrical wires or cables are installed between a power source and a power distribution box and routed to electrical boxes to supply electricity to a device. Often, these electrical wires or cables are routed through multiple conduits throughout the building spanning great distances. As such, installing electrical wires presents both logistical and mechanical challenges. Wires are typically installed in a building by pulling the wire via pulling cables through the building's infrastructure. The wire is spooled off of a reel assembly during the wire pulling process.

Wire is typically transported from a wire manufacturing site to the building construction or installation site on the reel assembly typically made from metal or wood. These reel assemblies can have diameters of up to 48 inches or more, and are capable of carrying thousands of pounds of wire. At the construction site, construction workers are faced with the challenge of spooling the large bulk of wire from the reel assembly during a wire pull. The size and weight of the reels when carrying cable or wire present many problems associated with installation at the installation site. The reel assembly is usually lifted off of the ground and set upon a pair of jack stands, which allows the reel to freely spin during a wire pull. During a wire pull, one end of the wire is attached to a pulling cable. Today, electric-powered machines are used to apply a pulling tension to the pulling cable, thereby spooling the wire off of the reel and through the building's infrastructure.

The use of jack stands to support the reel assembly during a wire pull has a number of significant disadvantages. For example, it requires heavy machinery or multiple personnel to lift a large reel from the ground to the jack stand platform. This use of heavy machinery is both costly and dangerous to construction workers. Also, jack stands are themselves large pieces of equipment. They are difficult to transport, and when installed, they consume a large amount of floor space at a construction site. For smaller construction sites, the jack stand can present significant space challenges during construction. One solution to the above is to deliver the reel and wire to the construction site on a portable jack stand installed on a flat-bed truck. However, this solution also has many disadvantages. First, the jack stands are large and limit the amount of available flat-bed space to transport multiple reels. Second, flat-bed trucks can take up a large amount of space at a construction site when positioned for spooling. Another solution is to use portable jack stands with built-in lifting mechanisms. However, these jack stands require additional equipment, and again, they can take up an inconvenient amount of space at a construction site while still requiring that the reels be lifted off of the ground and placed in a jack stand. Moreover, this solution requires the use of additional pieces of equipment with associated costs and space requirements.

Moreover, many installations require multiple wires to be dispensed and installed together. Traditionally, this requires a reel for each wire and a jack stand for each reel, which further compounds the issues discussed above.

Additionally, it may be difficult to pull and install heavy wire from a spool due to the weight and stiffness of the wire. Due to this issue, the installation of larger wire sizes may be very slow and physically demanding. Typically, the user implements a "tugger" attached to the end of the cable being pulled through the conduit or tray. This tugger carries the brunt of the force of the installation and the installation becomes increasingly difficult during installation of long lengths of wire or cable. Further, there is also the issue of the wire overspinning and becoming tangled and damaged. There is also no way to easily re-wind excess large gauge wire back onto a spool or reel. Reels and spools are limited in the amount of weight capacity they can hold before the reel or spool fails.

A prior art solution of dispensing multiple wires includes incorporating multiple bays in one reel, which each wire spooled into each bay. This solution is susceptible to the faults of the prior art solutions discussed above. Additionally, in some installations, at least one wire may be of a different thickness than the remaining wires. In this situation, for each rotation of the reel, more wire of the smaller diameter is dispensed than of the larger diameter wire often causes twists, kinks, or other issues related to efficiently dispensing a plurality of wires for installation at the same time.

Another prior art solution of dispensing wire requires a user manually pull the wire by hand or a tugger to pull and install the wire. Once a user has finished the installation, the remaining wire then needs to be re-spooled on the reel. The current method of re-spooling the wire is by hand manually. This is difficult due to the weight of the wire and the diameter of the reel.

Thus, there is need in the art for an apparatus and method to eliminate the hand pulling and re-spooling of wire. There is also need in the art for a reel system that is compact, easily transportable, and capable of spooling and re-spooling wire while resting on the ground or some other surface at the worksite.

BRIEF SUMMARY OF THE INVENTION

The present disclosure is directed to an apparatus for spooling wire. In one embodiment, the apparatus is a reel assembly comprising an inner flange assembly and an outer flange assembly. The inner flange assembly is supported by the outer flange assembly and capable of freely rotating relative to the outer flange assembly. A motor assembly rotates the inner flange assembly.

In another embodiment, a method is disclosed for spooling wire from a reel. The reel assembly comprises an inner flange assembly and an outer flange assembly. Wire is wrapped around the inner flange assembly for spooling. The inner flange assembly is supported by the outer flange assembly and capable of freely rotating relative to the outer flange assembly. Wire is spooled from the reel assembly while the assembly rests directly on the ground or some other surface.

In one embodiment, the inner flange assembly of the reel is spun by an external motor temporarily mounted on the outer flange assembly of the reel, without the assistance of manual labor. This motorized reel increases the level of safety for the users. The motorized reels direction may be reversed to re-spool any unused wire. The motor may be removed from the reel at the discretion of the user and mounted to any reel. Additional, the motorized reel allows the reel to be more robust, spin more freely, and hold a higher payload.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

In the drawings.

DETAILED DESCRIPTION OF THE INVENTION

Figure 1:
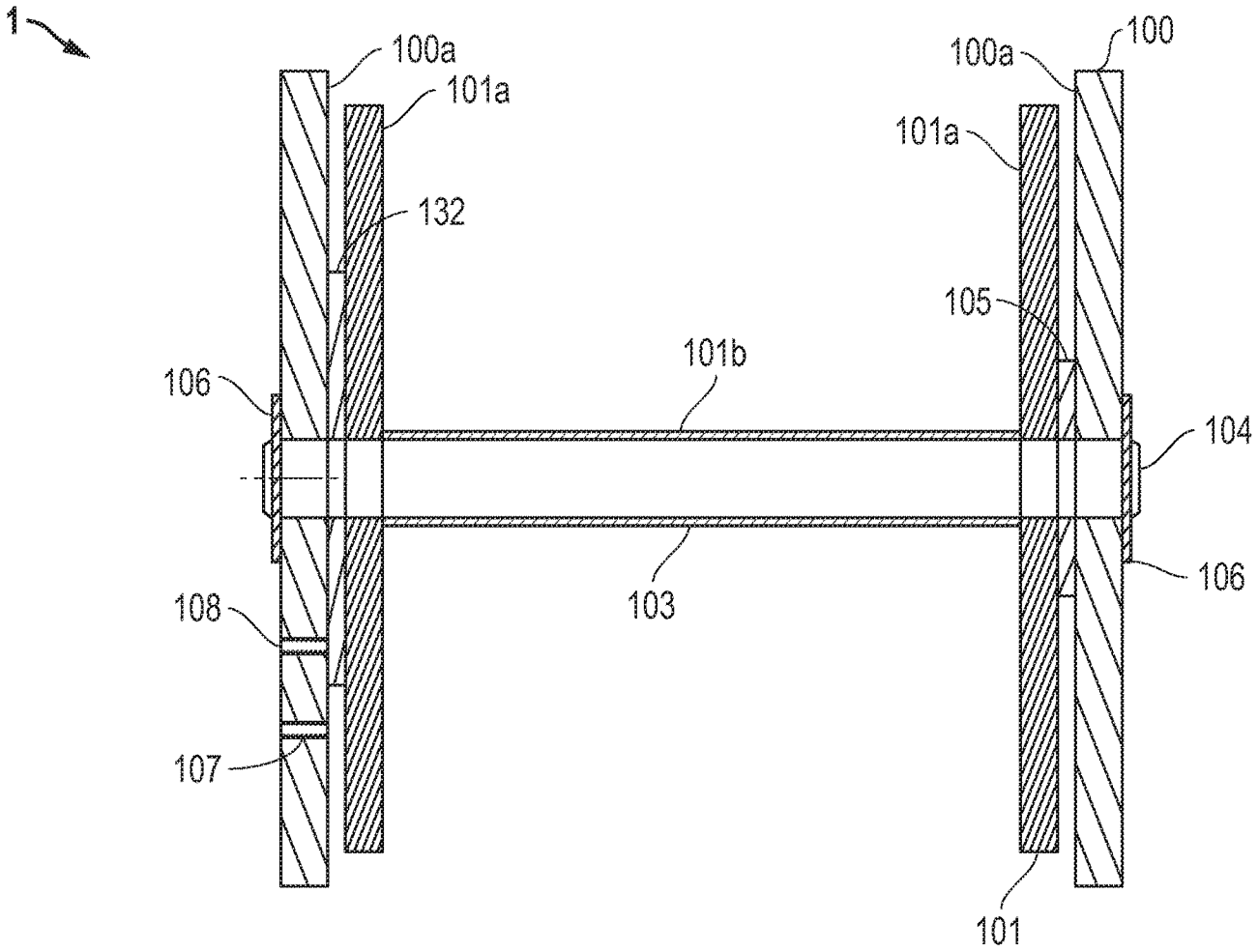
FIG. 1 depicts a front view of one embodiment of the reel assembly.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It should be understood that any one of the features of the invention may be used separately or in combination with other features. Other systems, methods, features, and advantages of the present invention will be or become apparent to one with skill in the art upon examination of the drawings and the detailed description. It is intended that all such additional systems, methods, features, and advantages be included within this description, be within the scope of the present invention, and be protected by the accompanying claims.

The present disclosure is described below with reference to the Figures in which various embodiments of the present invention are shown. The subject matter of the disclosure may, however, be embodied in many different forms and should not be construed as limited to the exemplary embodiments set forth herein. It is also understood that the term "wire" is not limiting, and refers to wires, cables, electrical lines, or any other materials that are spooled from a reel.

The present disclosure is directed to an apparatus and method for spooling wire. In one embodiment, the apparatus is a reel assembly comprising an inner flange assembly and an outer flange assembly. The inner flange assembly is supported by the outer flange assembly and capable of freely rotating relative to the outer flange assembly. With this design, a motor assembly is mounted to the outer flange assembly to rotate the inner flange assembly so the wire can be spooled from the reel assembly while the assembly rests directly on the ground or some other surface.

Referring to FIGS. 1-7 by way of a non-limiting example, and consistent with the embodiments of the invention, a reel assembly 1 is shown. The reel assembly 1 has an outer flange assembly 100, an inner flange assembly 101 and a pipe 103. The outer flange assembly 100 includes two outer supporting walls 100*a* of substantially equal size and shape connected to the pipe 103 and an outer washer 106. In one embodiment, the end of the pipe 103 is machined to form a lip 104 that has a diameter larger than the inner diameter of the outer washer 106, thus enclosing all outer flange assembly 100 components and securing the outer supporting walls 100*a* to the pipe 103. In another embodiment, a threaded pipe with a nut enclosing all outer flange assembly 100 components and securing the outer supporting walls 100*a* to the pipe 103. It is understood to one skilled in the art that a wide variety of enclosing and securing elements may be implemented without detracting from the spirit of the invention. The outer supporting walls 100*a* can be various shapes, including but not limited to circular, quadrilateral, or triangular. In one embodiment, the outer supporting walls 100*a* are circular.

The inner flange assembly 101 is formed by at least two inner supporting walls 101*a* of substantially equal size and shape connected by an inner drum 101*b* with an internal radius greater than the radius of the pipe 103. The inner supporting walls 101*a* of the inner flange assembly 101 can also be various shapes, including but not limited to circular, quadrilateral, or triangular. Additionally, the inner supporting walls 101*a* can be bolted to the inner drum 101*b* or can be connected to the inner drum 101*b* in a variety of methods known to those skilled in the art. In one disclosed embodiment, the inner supporting walls 101*a* are circular. Furthermore, in one disclosed embodiment, the inner supporting walls 101*a* are smaller than the outer supporting walls 100*a*. For example, the overall dimensions of the inner supporting walls 101*a* are less than the outer supporting walls 100*a* to allow free spinning of the inner supporting walls 101*a* relative to the outer flange assembly 100 when the inner flange assembly 101 is inserted over the pipe 103. The distance between the inner supporting walls 101*a* is less than the distance between the outer supporting walls 100*a* such that the inner flange assembly 101 is designed to fit within the outer supporting walls 100*a*. An inner washer 105 separates the inner supporting walls 101*a* from the outer supporting walls 100*a* on the non-motorized side of the reel 1. A toothed gear 132 is fixedly attached to the inner supporting wall 101*a* on the motorized side of the reel 1. The inner drum 101*b* of the inner flange assembly 101 is designed such that the inner diameter of the inner drum 101*b* is slightly larger than the outside diameter of the pipe 103 to allow free rotation without significant play.

Figure 2:
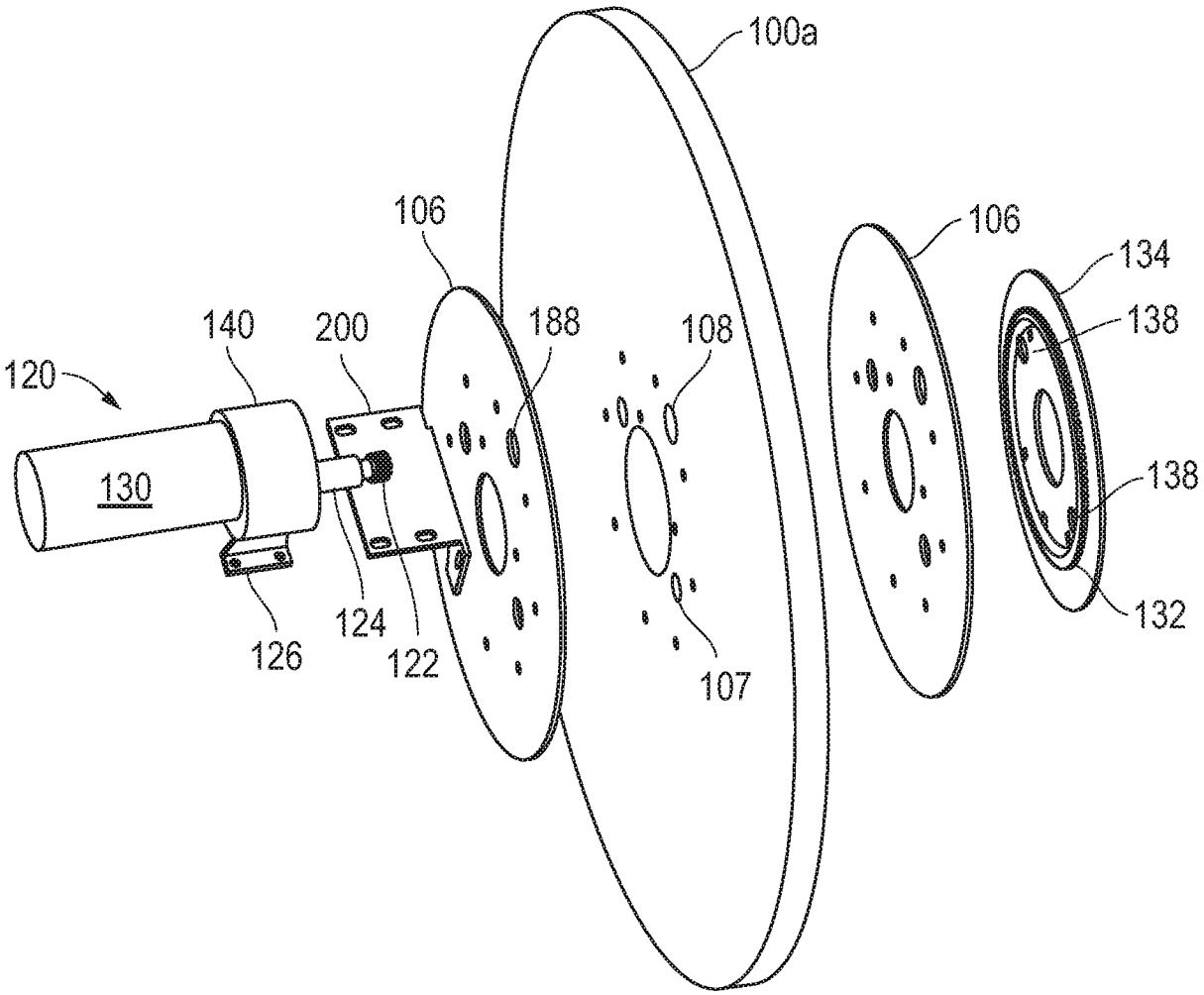
FIG. 2 depicts an exploded view of one embodiment of the reel assembly.
Figure 3:
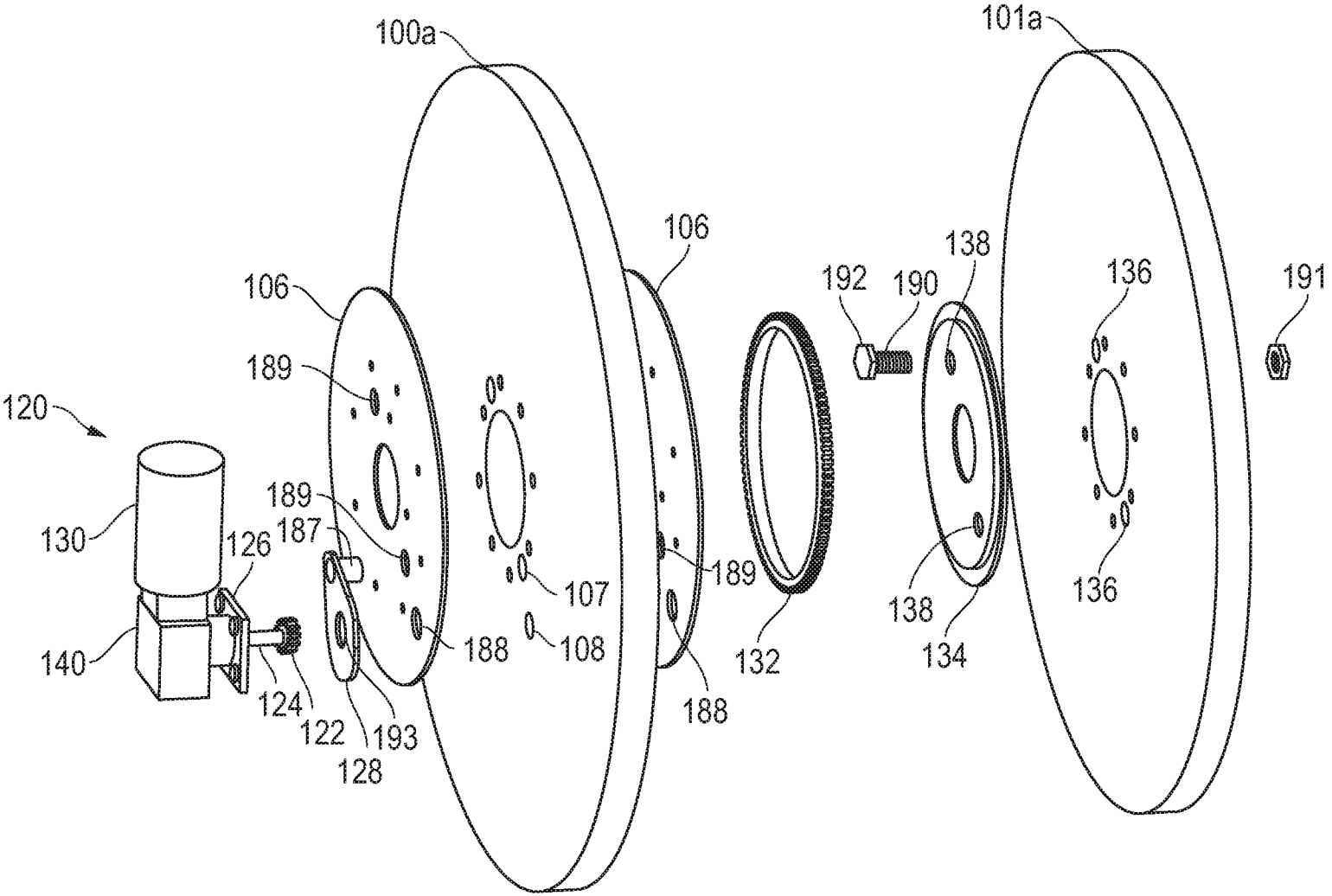
FIG. 3 depicts an exploded view of one embodiment of the reel assembly.
Figure 4:
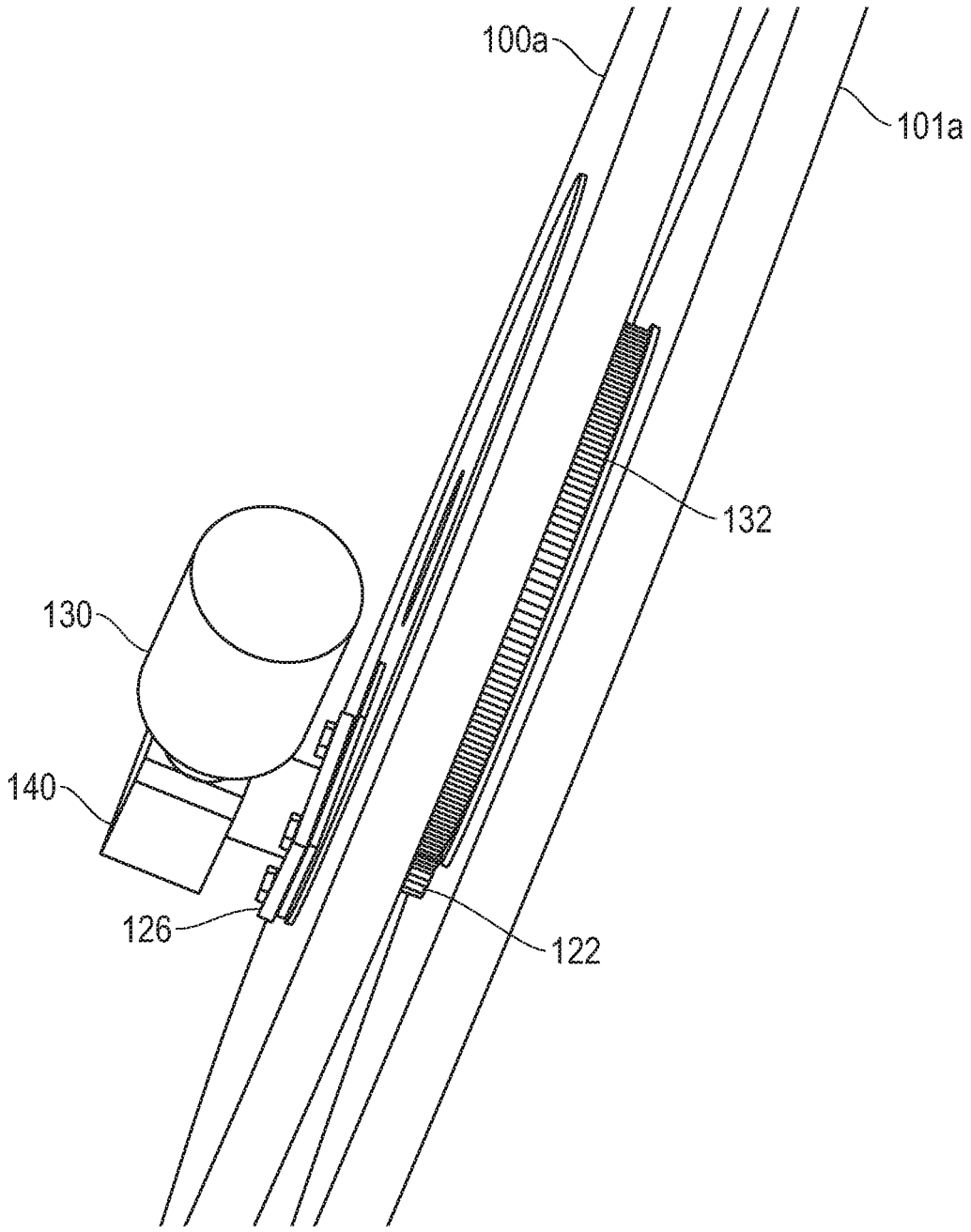
FIG. 4 depicts a perspective view of one embodiment of the reel assembly.
Figure 5:
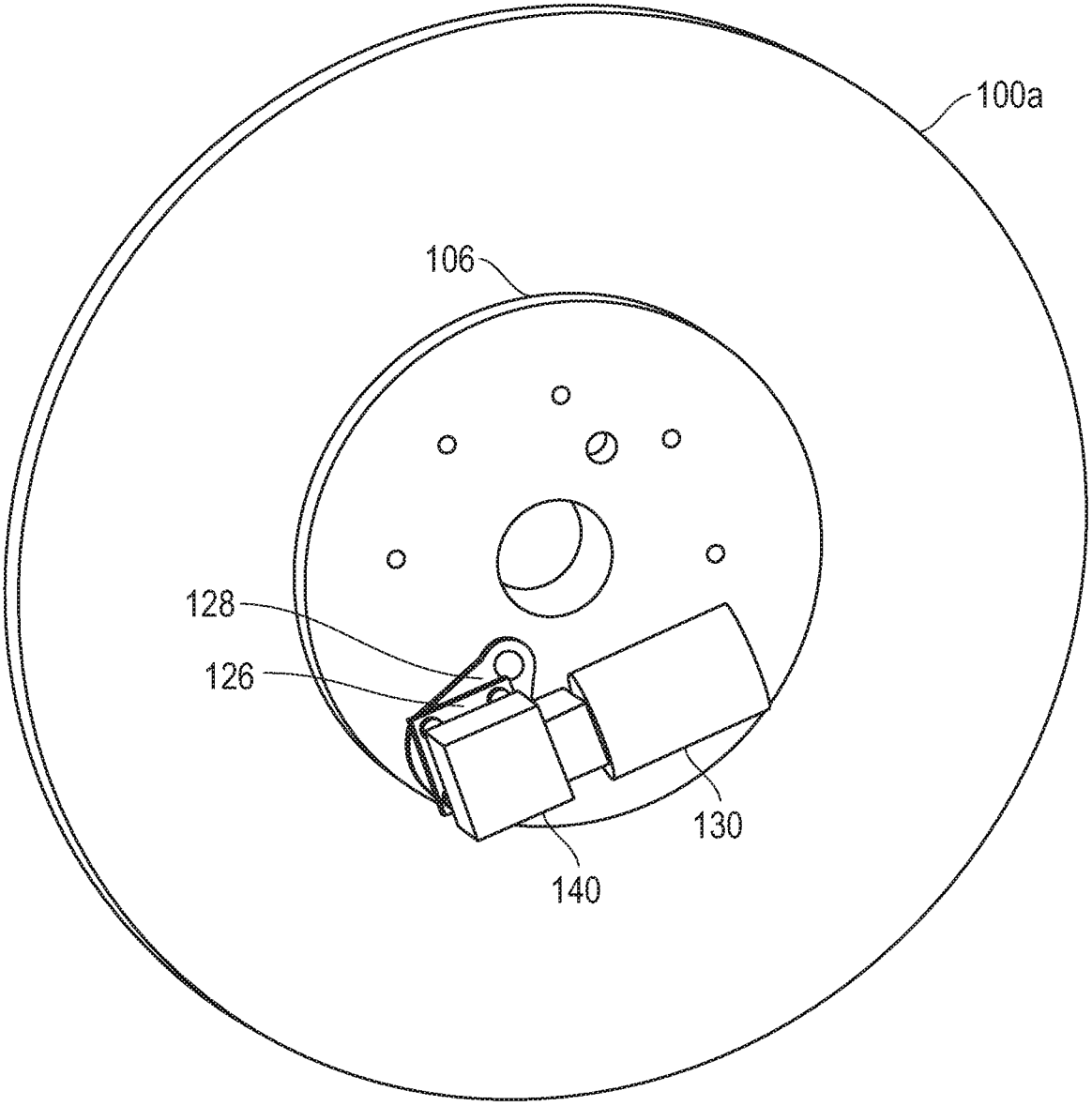
FIG. 5 depicts an end view of one embodiment of the reel assembly.
Figure 6:
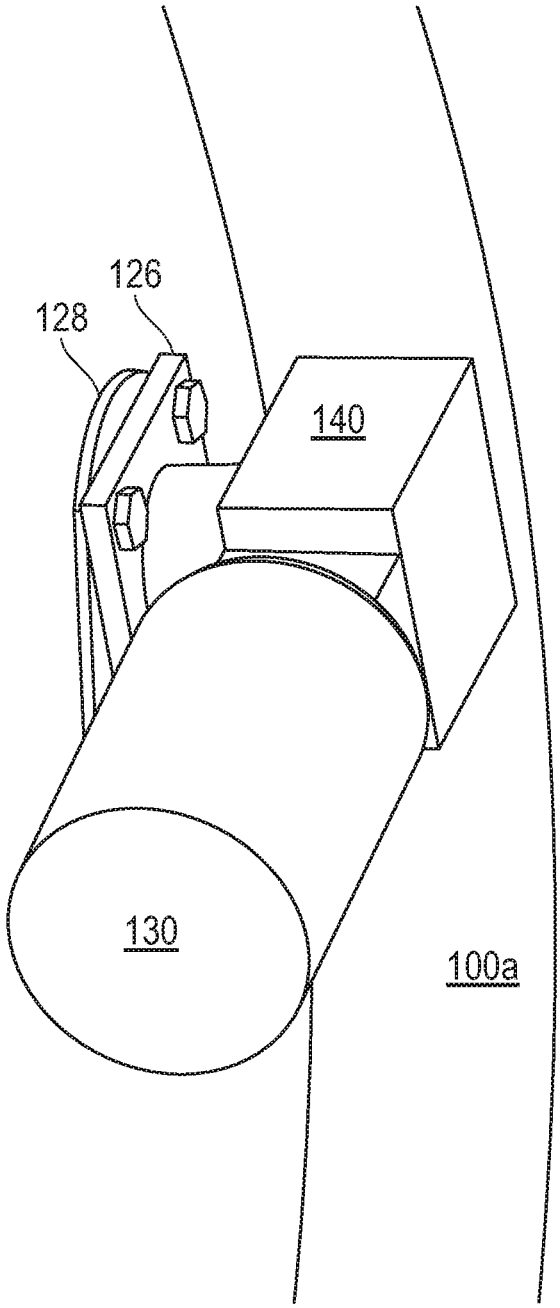
FIG. 6 depicts a perspective view of one embodiment of the reel assembly.
Figure 7:
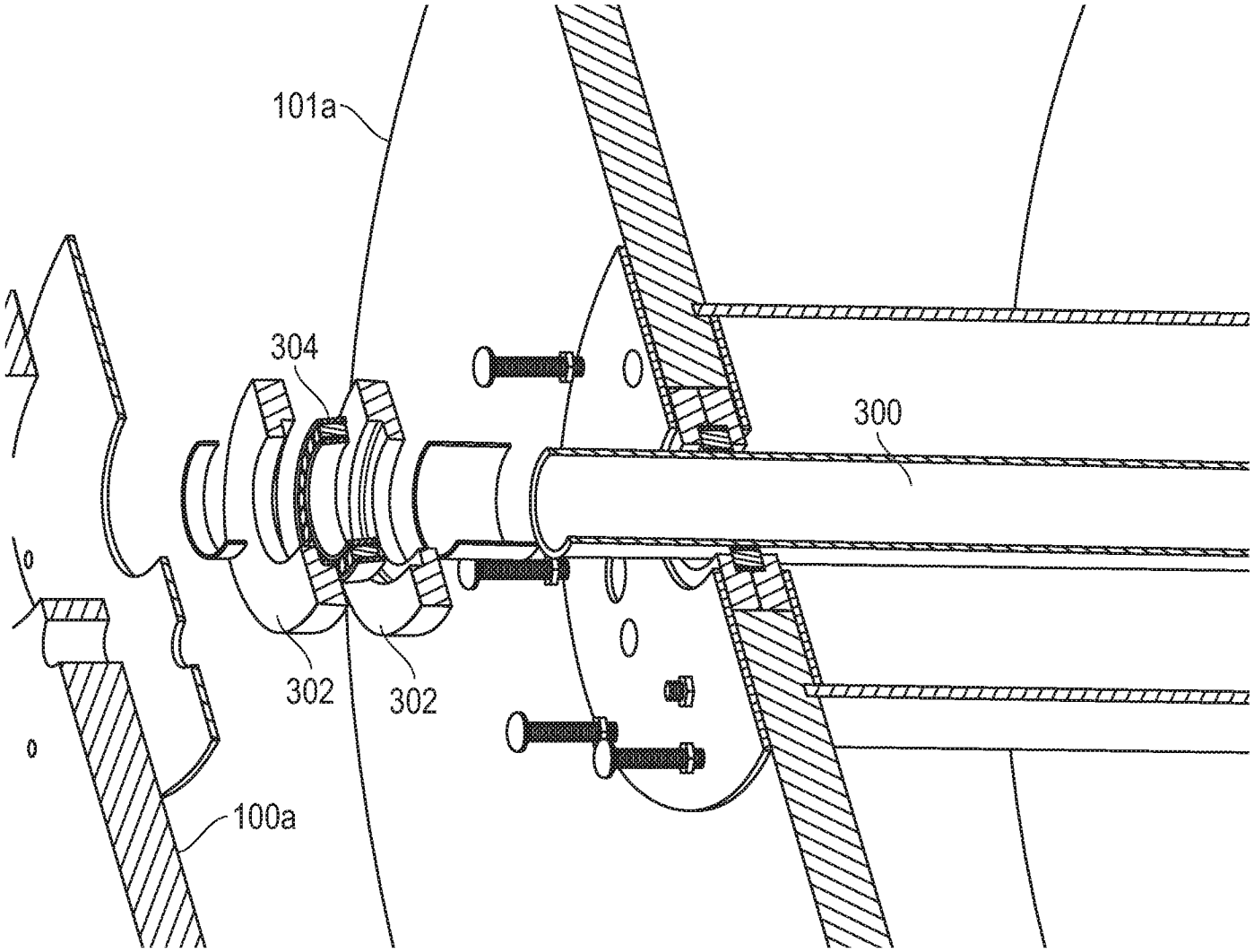
FIG. 7 depicts an exploded view of one embodiment of the reel assembly.

The reel 1 may be a motorized reel for spooling and re-spooling wire. The reel 1 includes a toothed gear 132 attached to or mounted on the outer wall of one of the inner supporting walls 101*a* on the motorized side of the reel 1. An access hole 108 is provided in at least one of the outer supporting walls 100*a*. The access hole 108 is larger than a motor gear 122 and a motor rod 124. The motor gear 122 is attached to a motor 130 (or engine) through a gear box 140 and the motor rod 124, forming a motor assembly 120. The motor assembly 120 may be permanently or temporarily mounted to one of the outer supporting walls 100*a* through connection plate 126. In one embodiment as shown in FIG. 3, a support bracket 128 attaches to both the outer washer 106 and the outer supporting wall 100*a* through the insertion of a post 187 of the support bracket 128 through the attachment hole 107 of the outer supporting wall 100*a* and the outer washer support holes 189 of the outer washers 106. In this embodiment, the connection plate 126, when installed, is bolted or screwed through the support bracket 128 or the support bracket 128 is pressed between the connection plate 126 and the outer supporting wall 100*a*. When installed, a support hole 193 in the support bracket 128 aligns with the outer washer gear holes 188 and the access hole 108 of the outer supporting wall 100*a*. The motor gear 122 and the motor rod 124 pass through the outer washer gear hole 188, the support hole 193 in the support bracket 128, and the outer washer gear holes 188 during use of the motor assembly 120. In one embodiment as shown in FIG. 2, the connection plate 126 connects to bracket 200 through nuts and bolts (not shown) and the bracket 200 is attached to the outer supporting wall 100*a* and the outer washers 106 through nuts and bolts or screws (not shown). When attached, the bracket 200 aligns the outer washer gear holes 188 and the access hole 108 of the outer supporting wall 100*a* with the path of the motor gear 122 and the motor rod 124.

The motor gear 122 is temporarily or permanently placed through the access hole 108 and engages the toothed gear 132 in such a way that the teeth from a motor gear 122 can mesh with the teeth of the toothed gear 132. The toothed gear 132 and the inner flange assembly 101 are then rotated by the spinning of the motor gear 122 by the motor 130. The motor 130 is controlled by a control box (not shown), allowing the user to stand clear of the reel 1 and operate it safely. The control box may be connected to the motor 130 through wires or through wireless technology. The control box may be attached to the motor 130, removable attached to the motor 130, or have to wire connection to the motor 130. The control box allows the operator to drive the inner flange assembly 101 either forward or backward depending on the operator's desire to spool or re-spool the wire. The operator also controls the speed in which the inner flange assembly 101 turns in either direction. The motor 130 includes a physical connection plate 126 to connect it securely to the mounting points on the outer flange assembly 100. The motor 130 has enough torque to control the speed of the inner flange assembly 101 in either direction whether pushing or pulling product that is loaded on the reel 1. In unloading the reel 1, the powered reel 1 would alleviate the strain from a single point of force pulling the wire, allowing for faster and easier spooling of the wire. A wide variety of motors or engines may be implemented without detracting from the spirit of the invention including, but not limited to, an electric motor and a gas-powered engine.

The toothed gear 132 is connected to the gear disk 134. The gear disk 134 is connected to one of the inner supporting walls 101*a* through a variety of attachment mechanisms, including but not limited to nuts and bolts. In one embodiment, a connection hole 138 of the gear disk 134 may be used to connect the gear disk 134 to one of the inner supporting walls 101*a* through inner flange hole 136. A nut 191 and bolt 190 may be used to attach the gear disk 134 to one of the inner supporting walls 101*a* through connection hole 138 and inner flange hole 136. In one embodiment, the connection hole 138 may be offset or countersunk with a cavity to allow for a head 192 of the bolt 190, when attached, to be completely within the cavity or flush with the gear disk 134 and allow the gear disk 134 to rotate without the head 192 of the bolt 190 being in contact with the outer washer 106. In one embodiment, the toothed gear 132 and gear disk 134 are combined as a single device. The toothed gear 132 and gear disk 134 are rotationally connected to an outer washer 106 and, as such, the toothed gear 132 and gear disk 134 may move independently from the outer washer 106.

The motor 130 may either be directly attached to the connection plate 126 or by the use of a reduction gear box 140. Reel chocks (not shown) may be placed against the reel 1 to prevent the outer flanges 100 from rolling when properly set in place. The reel 1 may be made from materials such as wood, metal, or plastic and the reel may be a hybrid of multiple materials.

The reel 1 may include a metal axle 300 and bearings 304 on each of the outer flange assemblies 100 and inner flange assemblies 101. Each bearing 304 is housed in a nylon race and held in place by the metal flange plates 302. The bearings 304 allow the inner flange assembly 101 to rotate smoothly with less static friction, making the force to start a pull lower. The metal axle 300 is machined to hold each flange 302 in place, allowing for less flexibility. The metal axle 300, bearings 304 and flange plates 302 together allow for increased capacity on the reel.

Although the invention is described herein with reference to specific embodiments, various modifications and changes can be made without departing from the scope of the invention as set forth in the claims below. Accordingly, the specification and figures are to be regarded in an illustrative rather than a restrictive sense, and all such modifications are intended to be included within the scope of the invention. Any benefits, advantages, or solutions to problems that are described herein with regard to specific embodiments are not intended to be construed as a critical, required, or essential feature or element of any or all the claims.

From time-to-time, the invention is described herein in terms of these example embodiments. Description in terms of these embodiments is provided to allow the various features and embodiments of the invention to be portrayed in the context of an exemplary application. After reading this description, it will become apparent to one of ordinary skill in the art how the invention can be implemented in different and alternative environments. Unless defined otherwise, all technical and scientific terms used herein have the same meaning as is commonly understood by one of ordinary skill in the art to which this invention belongs.

The preceding discussion is presented to enable a person skilled in the art to make and use the invention. The general principles described herein may be applied to embodiments and applications other than those detailed below without departing from the spirit and scope of the invention as defined by the appended claims. The invention is not intended to be limited to the embodiments shown, but is to be accorded the widest scope consistent with the principles and features disclosed herein.

In addition, while a particular feature of the invention may have been disclosed with respect to only one of several embodiments, such feature may be combined with one or more other features of the other embodiments as may be desired. It is therefore, contemplated that the claims will cover any such modifications or embodiments that fall within the true scope of the invention.

The various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one", "one or more" or the like; and adjectives such as "conventional", "traditional", "normal", "standard", "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more", "at least", "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Unless stated otherwise, terms such as "first" and "second" are used to arbitrarily distinguish between the elements such terms describe. Thus, these terms are not necessarily intended to indicate temporal or other prioritization of such elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in the field or any related fields are intended to be within the scope of the following claims.

What is claimed is:

1. A reel apparatus comprising:

a reel assembly, wherein the reel assembly is in the shape of a spool, the reel assembly comprising:

a pipe;

an outer flange assembly comprising two circular outer support walls wherein each circular outer wall is connected to the pipe, wherein each circular outer support wall comprises an inner wall and an outer wall, and wherein the two circular outer support walls are not directly connected to each other;

an inner flange assembly comprising two inner support walls, wherein the inner flange assembly is rotated relative to the outer flange assembly and the pipe and wherein each inner support wall comprises an inner wall and an outer wall; and a motor assembly connected to the inner flange assembly and outer flange assembly, wherein the motor assembly is physically connected to the outer flange assembly and wherein the motor assembly is rotationally connected to the inner flange assembly.

2. The reel apparatus of claim 1 further comprising an outer washer located on the outer wall of one of the circular outer support walls.

3. The reel apparatus of claim 2, wherein the outer washer is located between the circular outer support wall and a flared end of the pipe.

4. The reel apparatus of claim 2, wherein the outer washer is located between the circular outer support wall and a threaded pipe and nut.

5. The reel apparatus of claim 1, wherein the motor assembly comprises:

a motor a motor rod comprising a first end and a second end, wherein the motor is attached to the first end of the motor rod; and a motor gear attached to the second end of the motor rod; wherein the motor rotationally spins the motor rod and the motor gear.

6. The reel apparatus of claim 5 further comprising a gear box located between the motor and the motor rod.

7. The reel apparatus of claim 5 further comprising a toothed gear attached to the outer wall of one of the inner support walls.

8. The reel apparatus of claim 7, wherein the motor gear rotationally engages the toothed gear, rotating the inner flange assembly without rotating the outer flange assembly.

9. The reel apparatus of claim 7, wherein the motor gear and motor rod pass through an access hole in one of the circular outer support walls.

10. The reel apparatus of claim 5, wherein the motor assembly is permanently attached to the circular outer support wall of the outer flange assembly.

11. The reel apparatus of claim 5, wherein the motor assembly is temporarily attached to the circular outer support wall of the outer flange assembly.

12. The reel apparatus of claim 5 further comprising a connection plate attached to the motor assembly and one of the circular outer support walls of the outer flange assembly.

13. The reel apparatus of claim 12, wherein the connection plate is bolted to the circular outer support wall of the outer flange assembly.

14. The reel apparatus of claim 12, wherein the connection plate is temporarily bolted to the circular outer support wall of the outer flange assembly.

15. The reel apparatus of claim 12 further comprising a support bracket attached between the connection plate and one of the circular outer support walls of the outer flange assembly.

16. The reel apparatus of claim 15, wherein the support bracket comprises a post, wherein the post is inserted in a hole of the circular outer support wall of the outer flange assembly.

17. The reel apparatus of claim 15, wherein the support bracket comprises a support hole which aligns with the access hole of the circular outer support wall of the outer flange assembly.

18. The reel apparatus of claim 15 further comprising a bracket attached to the connection plate.

19. The reel apparatus of claim 18, wherein the bracket is attached to one of the circular outer support walls of the outer flange assembly.

20. The reel apparatus of claim 18, wherein the bracket is attached to one of the circular outer support walls of the outer flange assembly and the outer washer.

* * * * *